United States Patent [19]

Checko

[11] 4,096,973

[45] Jun. 27, 1978

[54] PORTABLE SEALANT APPLICATOR

[76] Inventor: John C. Checko, 5 Northern Dr., Bridgewater, N.J. 08807

[21] Appl. No.: 667,863

[22] Filed: Mar. 17, 1976

[51] Int. Cl.[2] ..... B67D 5/62

[52] U.S. Cl. ..... 222/146 HE; 219/421; 222/238; 222/318; 425/217; 425/379 R

[58] Field of Search ..... 222/146 HE, 318, 383, 222/240, 241, 242, 257, 270, 235, 238, 236, 255, 146 H, 146 HS, 146 R; 219/421; 401/1, 2; 425/217, 379

[56] References Cited

U.S. PATENT DOCUMENTS

| | | | |
|---|---|---|---|
| 2,809,772 | 10/1957 | Weisz | 219/421 X |
| 2,821,476 | 1/1958 | Green | 222/240 X |
| 2,851,197 | 9/1958 | Colton | 222/318 X |
| 2,879,920 | 3/1959 | Davies | 222/383 X |
| 3,212,131 | 10/1965 | Aichele | 222/146 R |
| 3,239,103 | 3/1966 | Kelley | 222/146 HE X |
| 3,531,023 | 9/1970 | Mercer | 222/146 HE |
| 3,662,927 | 5/1972 | Cocks | 222/146 HE |
| 3,758,001 | 9/1973 | Callan | 222/146 HE |
| 3,853,410 | 12/1974 | Busoni | 222/146 HE X |
| 3,879,150 | 4/1975 | Brown et al. | 222/238 X |

*Primary Examiner*—Robert B. Reeves
*Assistant Examiner*—Fred A. Silverberg
*Attorney, Agent, or Firm*—Lerner, David, Littenberg & Samuel

[57] ABSTRACT

Apparatus is provided for heating and extruding fluid sealant material onto a work surface which includes a heated feed chamber, a heated hose connected to the outlet of the feed chamber, and a handgun connected to the heated hose for applying the fluid sealant material onto the work surface. The feed chamber is provided with an opening for receiving sealant material is a solid bulk form and an outlet for dispensing sealant material in a fluid state. Heating coils are disposed on the outer walls of the feed chamber for heating the bulk sealant contained therein to a fluid state having a pumpable viscosity. The hose connected to the outlet of the feed chamber receives the fluid sealant material dispensed therefrom, and a heating coil surrounds the hose to maintain the sealant material passing therethrough in a fluid state. Within the feed chamber there is provided a rotatable screw conveyor feeding a positive displacement pump which may be driven at different rates to force fluid sealant material under high pressure into the heated hose so that the fluid sealant material is transmitted to the handgun under pressure. The heated handgun includes a removable nozzle which may be replaced to change the configuration of the sealant material which is extruded therefrom. A feedback arrangement is connected to the outlet of the positive displacement pump for returning the fluid sealant material to the feed chamber when the pressure in the heated hose reaches a predetermined level.

9 Claims, 5 Drawing Figures

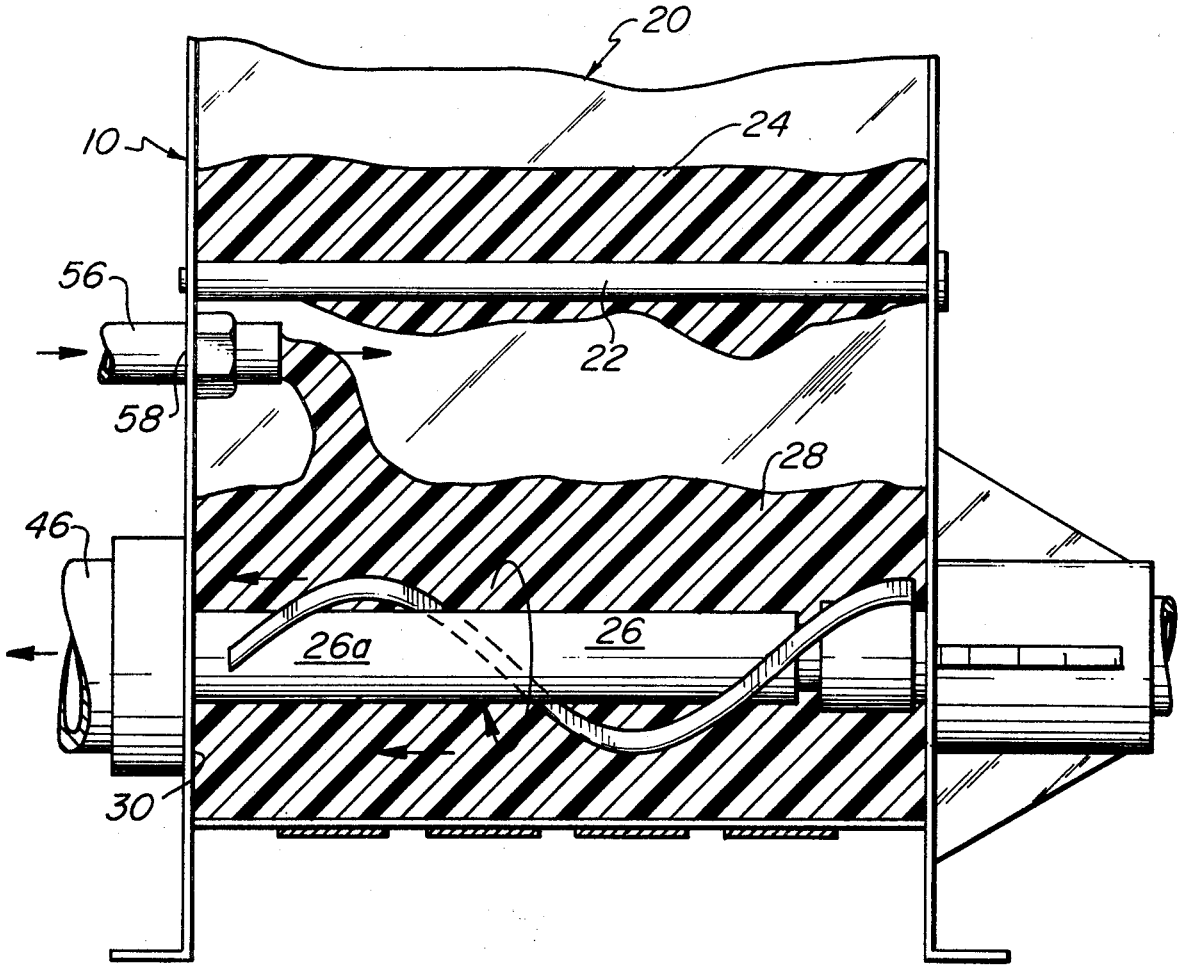
FIG. 2
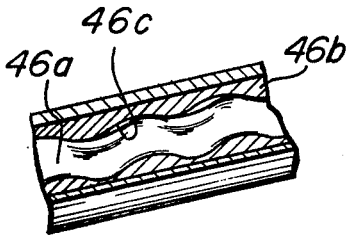
FIG. 5
FIG. 4
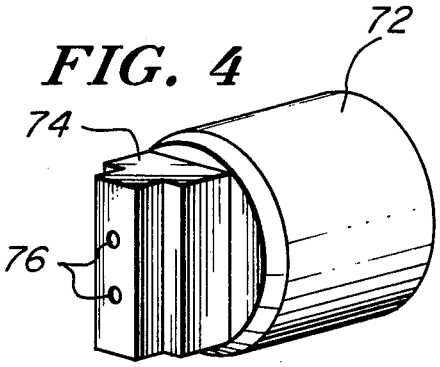

PORTABLE SEALANT APPLICATOR

FIELD OF THE INVENTION

The present invention relates generally to sealant applicators and, specifically to improved apparatus for heating and extruding fluid sealant material onto a work surface, which includes a portable feed chamber and pump which is capable of receiving sealant in bulk form and heating it so that it may be extruded through a hose under pressure to a pressure gun which operates to apply the fluid sealant material onto a work surface.

BACKGROUND OF THE INVENTION

In recent years, portable sealant applicators have been developed for applying butyl tape sealants and other rubber-based, hot-melt sealants. Such portable applicators provide variable extrusion rates of hot sealants at various temperatures. Such hot sealants are normally employed for manufacturing insulated glass, for applying bedding compounds, for sealing pressure and vacuum vessels, for insulation of automotive windshields, and for the application of expansion joints in highways.

Although such prior art devices are to some extent portable, they have various drawbacks. Typically, rope-shaped sealant must be manually fed into the sealant applicator and the rope sealant is forced by a rotating auger into an extrusion die at the end thereof. However, rope-shaped sealant costs about twice as much as sealant in bulk form, and the operator must continually manually supply the sealant to the applicator. It would, therefore, be highly desirable to provide a portable sealant applicator which is capable of using bulk sealant instead of continually fed rope shaped sealant.

In addition, such prior art sealant applicators typically include an auger arrangement for forcing the rope-shaped sealant through an extrusion die at the end thereof. However, the auger arrangement supplies the sealant material to the die under limited pressure and, therefore, limits the length and the type of die which may be employed. Such limited pressure also prevents a hose extension from being employed. Accordingly, it would be highly desirable to provide a portable sealant applicator using bulk material which is also capable of extruding fluid sealant material through a light weight portable hose extension under different amounts of pressure to vary the rate of extrusion.

Moreover, such prior art sealant applicators normally require two hands to operate and manipulate, while at the same time, the operator must guide the rope-shaped sealant into the applicator. As a result, it is difficult for a single operator to perform all of these functions and still properly orient and manipulate the applicator. Moreover, although such prior art sealant applicators are to some extent portable, they are heavy and unwieldy and, therefore, difficult to manipulate and line up with the work surface on which the sealant is to be applied. Accordingly, it would be highly desirable to provide a truly portable sealant applicator which may be easily and accurately manipulated by a single operator.

It should also be pointed out that such prior art sealant applicators which are of the portable type are not intended for high production use due to the limitations of supplying rope-shaped sealant. More particularly, the rope-shaped sealant is typically supplied in 1-pound bundles and therefore must continually be resupplied to the sealant applicator and such applicators are therefore not intended for high production operations. It would also be highly desirable to provide a portable sealant applicator which would be suitable for high production work.

Broadly, it is the object of the present invention to provide a sealant applicator which accomplishes one or more of the foregoing objectives. Specifically, it is within the contemplation of the present invention to provide an improved sealant applicator which is not only portable but is also capable of utilizing sealant material in cheaper bulk form and heating it to a fluid state for application to a work surface.

It is a further object of the present invention to provide an improved portable sealant applicator which operates under various pressures to vary the rate of sealant extrusion.

It is a still further object of the present invention to provide a portable sealant applicator which is easy for a single operator to manipulate with respect to the work surface and which is also capable of use in high production facilities, such as factories.

SUMMARY OF THE INVENTION

Briefly, in accordance with the principles of this invention, an improved sealant applicator is provided for heating and extruding flowable or fluid sealant material onto a work surface and includes a heated feed chamber, a positive displacement pump mounted on the feed chamber, a heated hose connected to the outlet of the pump, and a handgun connected to the heated hose for applying a fluid sealant material onto a suitable work surface. More particularly, the feed chamber includes an opening for receiving sealant material in bulk form, and an outlet for dispensing sealant material in a fluid or flowable state. Heating elements are disposed on the outer wall of the feed chamber for heating the bulk sealant material contained therein to a fluid state having a pumpable consistency or viscosity. The hose, which includes a heating coil surrounding the length of the hose, is connected to the outlet of the feed chamber and pump for receiving the heated fluid sealant material dispensed therefrom, and the heating coil of the hose operates to maintain the sealant material passing therethrough in its fluid state. A rotatably driven screw conveyor is disposed in the lower portion of the feed chamber for supplying the fluid sealant material to the pump which forces the heated fluid sealant material under pressure through the heated hose to the heated handgun. The heated handgun is light in weight, easy to manipulate, and is provided with a removable nozzle which may be changed for applying various configurations of the fluid sealant material onto different size work surfaces.

The sealant applicator of the present invention is portable as the feed chamber is mounted on wheels or any other suitable transporting means. The feed chamber further includes a material feedback arrangement connected between the pump and the feed chamber for returning fluid sealant material to the feed chamber when the pressure in the heated hose reaches a predetermined level or when the handgun is temporarily not in use. A pressure valve in the feedback arrangement operates to allow the passage of fluid sealant material from the pump back to an inlet port of the feed chamber when the pressure in the heated hose reaches said predetermined level. In addition, the pump and the feedback arrangement are provided with suitable heating means for maintaining the sealant material in its fluid state and at a predetermined temperature level.

Advantageously, the sealant applicator of the present invention is not only portable, but is capable of receiving sealant material in cheaper bulk form and heating it to its fluid or flowable state. This provides a great savings, as the cost of sealant in bulk form is approximately half the cost of rope-shaped sealant. Moreover, the portable sealant applicator of the present invention operates under a range of high pressures and volumes to vary the rate of sealant extrusion, and such pressure operation allows greater flexibility with respect to the size nozzle and the length of delivery hose employed with the pressure gun. In addition, the handgun of the portable sealant applicator of the present invention is light in weight, simple for a single operator to manipulate and to properly line up with the working surface to which the sealant is to be applied, and is not difficult to manipulate as are prior art sealant applicators. Finally, the portable sealant applicator of the present invention may be employed at high-production facilities, since the feed chamber is capable of holding a relatively large quantity of sealant.

In summary, the portable sealant applicator of the present invention is cheaper to operate becasue of its use of sealant in bulk form, has a high pressure range under which the sealant may be applied, has unlimited bulk sealant capacity, and is simpler to manipulate in applying the sealant to the working surface.

BRIEF DESCRIPTION OF THE DRAWINGS

Further objects, features and advantages of the present invention will become apparent upon the consideration of the following detailed description of the presently preferred embodiment when taken in conjunction with the accompanying drawing, wherein:

FIG. 2 is an elevational view of the internal arrangement of the feed chamber of the present invention;

FIG. 4 is a perspective view in detail of a removable nozzle employed with the pressure gun of the present invention; and FIG. 5 is a side view of a positive displacement pump employed in the present invention.

DETAILED DISCUSSION OF PREFERRED EMBODIMENT OF THE INVENTION

Figure 3:
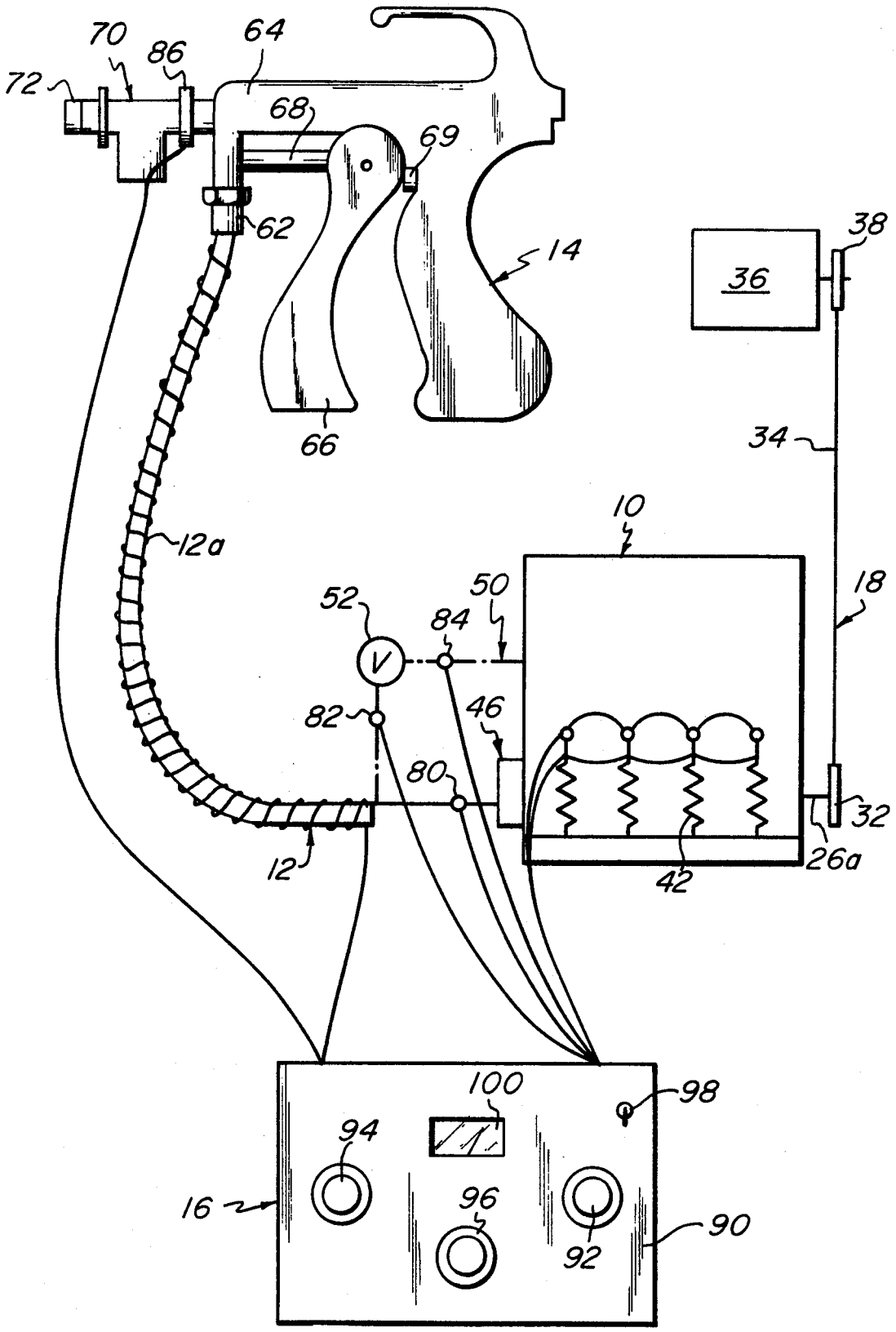
FIG. 3 is a diagrammatic view of the portable sealant applicator of hte present invention including the feed chamber, hte heated hose, the pressure gun, and the control box.

Referring first to FIG. 3, there is shown a diagrammatic view of the portable sealant applicator of the present invention including a feed chamber 10, pump 46, a feedback arrangement 50, a heated hose 12, a handgun 14, a control box 16, and a belt drive arrangement 18 for the feed chamber 10.

Figure 1:
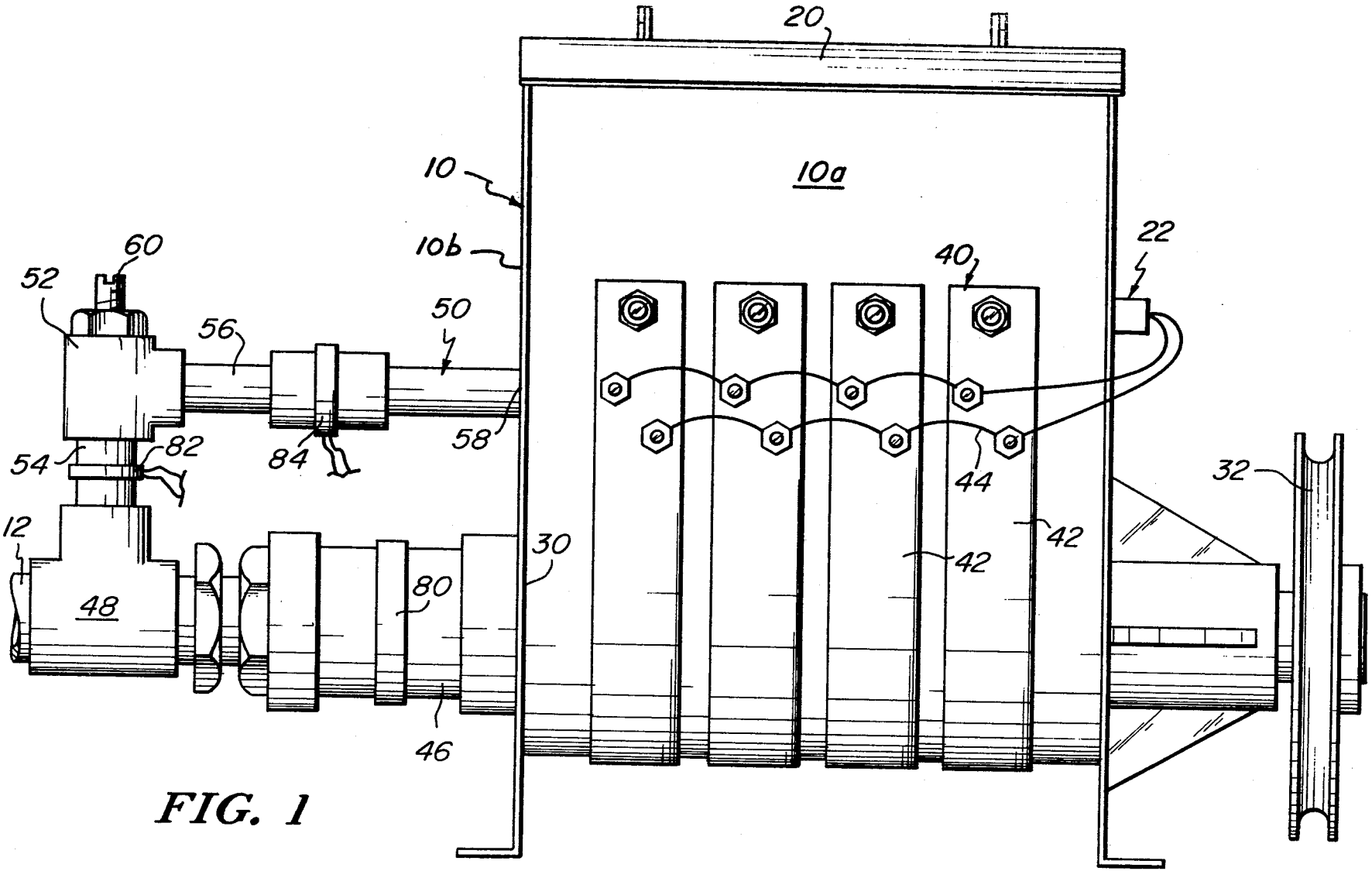
FIG. 1 is a side elevational view of the feed chamber, outlet means, and feedback arrangement of the sealant applicator of the present invention.

Referring now to FIGS. 1 and 2, there is a clear illustration of the feed chamber 10 of the present invention. The feed chamber 10 includes an opening 20 at its upper end for receiving sealant material in bulk form. Slightly below opening 20 there is provided a heated support member 22 for receiving and preheating the sealant material 24 in its bulk form. Preferably, support member 22 is in the form of a heated grid for supporting the hardened sealant until it is preheated to a fluid state and flows into the bottom of the feed chamber. An outlet 30 is provided in the bottom of the feed chamber for dispensing the sealant material.

Disposed in the bottom of the feed chamber is a rotatable screw conveyor 26 for supplying the fluid sealant material 28 to the pump 46. Pump 46 operates to force the sealant material under pressure into heated hose 12. Pump 46 is a positive displacement pump of the progressing cavity type and is of a conventional nature, commonly referred to as a Moyno pump. It will pump highly viscous fluids, such as the fluid sealant material described herein. The pump includes rotor-stator elements for pumping so that as the rotor **46*a* turns within the stator 46*b*, cavities 46*c*** are formed which progress toward the discharge end of the pump carring the material being handled uniformly and without pulsation or agitation.

The drive means 18 operates to drive rotatable screw conveyor 26 and pump 46 and includes a pulley 32 for driving the common shaft **26*a* of rotatable screw 26 and pump 46, a drive belt 34 for driving pulley 32, a motor 36 and a drive pulley 38 for imparting rotation to drive belt 34. As a result, drive arrangement 18, including motor 36, operates to continuously drive screw 26 and pump 46 for forcing the fluid sealant material 28 under pressure through heated hose 12 to handgun 14. A T-connector 48 is provided for connecting pump 46 to heated hose 12 and feedback arrangement 50. As shown most clearly in FIG. 1, feed chamber 10 also includes heating means 40 disposed on the outer walls of the feed chamber for further heating the bulk sealant material 24 preheated by heated grid 22 to a fluid state having a pumpable viscosity. The heating means 40 include separate heating elements 42 connected by wires 44. Preferably, heating elements extend about feed chamber 10 on each side wall 10*a*** thereof.

The feedback arrangement 50 of the present invention includes a pressure valve 52 connected by a feedback pipe 54 to T-connector 48, a feedback pipe 56, and an inlet port 58 formed on the end wall **10*b* of feed chamber 10. Pressure valve 52 includes a set screw 60 for setting the desired pressure value in the system. In operation, pump 45 continually forces fluid sealant 28 under pressure into heated hose 12, and if pressure gun 14 is not operated for a short period of time, the pressure may build up to an undesired level. Accordingly, when the set pressure level of valve 52 is exceeded, pressure valve 52 will open and allow the fluid sealant material 28 to be returned through feedback pipe 56 and inlet port 58 to feed chamber 10. Therefore, the feedback arrangement of the present invention provides a continuous arrangement for recirculating the fluid sealant material which is under pressure, and for allowing the pressure value in the system to be set at any desired predetermined level, and for the system to be maintained by the feedback arrangement 50 at the preset pressure, and thereby allow intermittent use of the handgun 14** by the operator.

As shown diagrammatically in FIG. 3, heated hose 12 is connected between pump 46 and handgun 14 for receiving fluid sealant material dispensed from the feed chamber. The heated hose 12 is surrounded with a heating coil **12*a* for maintaining the sealant material passing therethrough in a fluid state. Heated hose 12 further includes a heat sensor, such as a thermistor, for controlling the temperature in the hose, a thermostat override as a safety feature which operates to shut off the supply of heat to heating coil 12*a* at a preset maximum temperature, and a thermocouple connected to control box 16 for reading the temperature level in hose 12**.

Handgun 14 includes a swivel connection 62 for supplying the fluid sealant material to a chamber 64 formed in the handgun. The handgun 14 also includes a trigger-operated handle 66 which is spring biased between its operative and inoperative position by biasing means 68. A stop 69 is also provided to adjust the movement of handle 66 to thereby control the rate of flow of sealant material. The output means 70 of pressure gun 14 includes a nozzle 72 for applying the fluid sealant material onto a suitable work surface. Nozzle 72, shown in detail in FIG. 4, is removable from the output means 70 of the pressure gun and includes an extruding tip 74 having holes 76 formed therein for extruding the sealant material onto the work surface. As noted, nozzle 72 is removable from handgun 14 so that it may be interchanged with other size nozzles having different size extruding holes for varying the rate of flow of the sealant material, as well as the width or configuration of the strip of sealant material which is applied to the work surface.

As noted above, it is an important feature of the present invention to maintain the fluid sealant material passing therethrough at a predetermined temperature level so that the sealant material has a pumpable viscosity and so that it will not harden to clog up the system. In this regard, various heating rings or heating elements are provided throughout the system in addition to heating elements 42 provided on the outer walls of feed chamber 10 and heating coil 12*a* surrounding heated hose 12. The additional heating means include a heating ring 80 surrounding pump 46, and heating rings 82, 84 surrounding feedback pipes 54, 56, repsectively. In this manner, the sealant material, as it is passing through the system, is always being heated to maintain the sealant material in a fluid state and at a predetermined temperature level. Preferably, a suitable heating ring 86 is also applied to the output means 70 of handgun 14 to maintain the sealant material at its proper temperature level even when it is in handgun 14.

Turning now to FIG. 3, there is shown control box 16 for controlling heating elements 12*a*, 42, 80, 82, 84 and 86. Temperature controller 92 controls the temperature level of heating elements 42 and heating elements 80, 82, and 84, while temperature controller 94 controls the temperature level of heated hose coil 12*a* and heating ring 86. Selector switch 96 is provided to switch between temperature controllers 92, 94 to read the temperature of feed chamber 10 or heated hose 12 on gauge 100. However, it should also be understood that depending on the type of sealant material being employed, the present system will operate to heat the sealant material to a predetermined temperature level anywhere in the range of approximately 150° to 500° F. Control box 16 also includes a switch 98 for turning on motor 36 to supply power to drive belt arrangement 18, rotatable screw 26, and pump 46. In this regard, it has also been found to be desirable to energize the heating elements before the rotatable screw conveyor 26 is operated to insure that there is sufficient fluid sealant material contained in the feed chamber 10. In the present invention, rotatable screw conveyor 26 and pump 46 can be driven at any desired speed to maintain a pressure level in the system anywhere in the range of approximately 200 pounds psi to 500 pounds psi. It should also be pointed out that depending on the specific nozzle 72 being employed on handgun 14, that the rate of sealant extrusion may be anywhere in the range of 16 to 20 ounces per minute.

In view of the foregoing, it should be clear that the sealant applicator of the present invention is not only portable, but is capable of receiving sealant material 24 in cheaper bulk form and heating it to its fluid or flowable state. This provides a great savings in the cost of sealant employed in the system. In addition, the portable sealant applicator of the present invention operates under a range of high pressure to vary the rate of sealant extrusion. Moreover, the handgun 14 of the present invention is light in weight and simple for a single operator to manipulate, and to properly line up with the working surface to which the sealant to be applied. Finally, the portable sealant applicator of the present invention may be employed at high-production facilities, since the feed chamber 10 is capable of holding a relatively large quantity of sealant material.

A latitude of modification, change and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for heating and extruding flowable sealant material onto a work surface comprising:

a portable feed chamber having an opening for receiving sealant material in bulk form and an outlet for supplying sealant material in a fluid state to a pump device;

first heating means disposed with respect to said feed chamber for heating the bulk sealant material contained therein to a fluid state having a pumpable viscosity;

conveyor means disposed within said feed chamber for forcing said fluid sealant material through said outlet of said feed chamber under pressure into said pump device;

said pump device being disposed outside of said feed chamber with respect to said outlet for forcing the fluid sealant material under pressure through a heated hose, said pump device including second heating means for maintaining the sealant material passing therethrough at a predetermined temperature level; said pump device further including a rotor and a stator and being of the positive displacement type having progressing cavities formed as the rotor turns within the stator;

said heated hose being connected to said pump device for receiving fluid sealant material supplied therefrom under pressure, said heated hose including third heating means for maintaining the sealant material passing therethrough in a fluid state;

feedback means connected between said pump device and said heated hose for returning fluid sealant material to said feed chamber when the pressure in said heated hose reaches a predetermined level, said feedback means including fourth heating means for maintaining the sealant material passing therethrough in a fluid state; and means connected to said heated hose for applying said fluid sealant material onto a work surface.

2. Apparatus in accordance with claim 1 wherein said feedback means includes a return port formed in said feed chamber and a pressure valve connected to said pump device, said pressure valve being operative to allow the passage of fluid sealant material from said pump device to said return port when the pressure in said hose reaches a predetermined level.

3. Apparatus in accordance with claim 1 further including control means for controlling the temperature of said first, third, and fourth heating means relative to said second heating means of said heated hose.

4. Apparatus in accordance with claim 1 wherein said pump device is a Moyno-type pump, said conveyor means including a rotatable screw conveyor, said Moyno pump and said screw conveyor having a common drive, and said pump device being operative to force said fluid sealant material through said heated hose at predetermined pressures.

5. Apparatus in accordance with claim 1 wherein said feed chamber includes a heated grid adjacent said opening for supporting said bulk sealant material while it is being heated to a fluid state.

6. Apparatus in accordance with claim 1 wherein said first heating means of said feed chamber includes heating elements mounted on the outer walls of said feed chamber.

7. Apparatus in accordance with claim 1 wherein said applying means includes a handgun having a removable nozzle for extruding said fluid sealant material under pressure onto a work surface.

8. Apparatus in accordance with claim 7 wherein said handgun further includes heating means connected thereto for maintaining said sealant material in a fluid state.

9. Apparatus in accordance with claim 8 wherein the nozzle of said handgun is removable so that different size nozzles may be employed in conjunction with said handgun to vary the amount and configuration of sealant material which is extruded.

* * * * *

UNITED STATES PATENT AND TRADEMARK OFFICE

CERTIFICATE OF CORRECTION

PATENT NO. : 4,096,973

DATED : June 27, 1978

INVENTOR(S) : John C. Checko

It is certified that error appears in the above-identified patent and that said Letters Patent are hereby corrected as shown below:

In the ABSTRACT, line 7, the word "is" should read -- in --.

Column 4, line 43, the numeral "45" should read -- 46 --.

Signed and Sealed this

*Fifth* Day of *December 1978*

[SEAL]

*Attest:*

RUTH C. MASON
*Attesting Officer*

DONALD W. BANNER
*Commissioner of Patents and Trademarks*